US010744046B2

(12) United States Patent
Longin et al.

(10) Patent No.: US 10,744,046 B2
(45) Date of Patent: Aug. 18, 2020

(54) LIFTING DEVICE FOR A WHEELCHAIR, AND MOTOR VEHICLE

(71) Applicant: FORD GLOBAL TECHNOLOGIES, LLC, Dearborn, MI (US)

(72) Inventors: David Longin, Flanders (BE); Gunther Cuypers, Limburg (BE); Roel Hannes, Antwerp (BE); Eduard De Jong, Zuid-Holland (NL)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/190,983

(22) Filed: Nov. 14, 2018

(65) Prior Publication Data

US 2019/0142658 A1 May 16, 2019

(30) Foreign Application Priority Data

Nov. 14, 2017 (DE) ..... 10 2017 220 197

(51) Int. Cl.

| | |
|---|---|
| ***A61G 3/02*** | (2006.01) |
| ***A61G 3/06*** | (2006.01) |
| ***A61G 3/08*** | (2006.01) |

(52) U.S. Cl.

CPC ..... *A61G 3/0209* (2013.01); *A61G 3/062* (2013.01); *A61G 3/0808* (2013.01)

(58) Field of Classification Search

CPC ..... A61G 3/0209; A61G 3/062; A61G 3/0808
See application file for complete search history.

(56) References Cited

U.S. PATENT DOCUMENTS

| | | | | |
|---|---|---|---|---|
| 4,073,395 | A * | 2/1978 | Clement | B60R 5/04 224/548 |
| 4,616,972 | A | 10/1986 | McFarland | |
| 5,242,257 | A * | 9/1993 | Avakian | A61G 3/0209 224/310 |
| 5,746,563 | A * | 5/1998 | Steckler | B60R 9/0426 414/462 |
| 7,306,422 | B2 | 12/2007 | Dupuy et al. | |
| 9,139,122 | B2 | 9/2015 | Esparza | |

(Continued)

FOREIGN PATENT DOCUMENTS

| | | | |
|---|---|---|---|
| DE | 102011103382 | A1 | 12/2012 |
| DE | 202014100151 | U1 | 4/2015 |
| DE | 102014115834 | A1 | 5/2015 |

OTHER PUBLICATIONS

DE Examination Report DE 10 2017 220 197.5 Filed May 14, 2018. 7 pages.

(Continued)

*Primary Examiner* — Kaitlin S Joerger
(74) *Attorney, Agent, or Firm* — Gregory P. Brown; Brooks Kushman P.C.

(57) ABSTRACT

A lifting device for lifting a wheelchair into and out of a rear loading space of a motor vehicle includes lifting assemblies, fastened within a loading space of the vehicle, each having a pivot bearing; a telescopic lifting arm, connected to the pivot bearings to pivot about an axis in the vehicle transverse direction; a transverse stay which runs in the vehicle transverse direction, connected to free end portions of the lifting arms; and a coupling unit disposed on the transverse stay and configured to couple at least indirectly to the wheelchair.

16 Claims, 4 Drawing Sheets

(56) References Cited

U.S. PATENT DOCUMENTS

| | | | | |
|---|---|---|---|---|
| 10,485,716 | B2 * | 11/2019 | Yang | A61G 3/062 |
| 2005/0105995 | A1 | 5/2005 | Freet et al. | |
| 2007/0189885 | A1 | 8/2007 | Madormo et al. | |
| 2008/0069675 | A1 * | 3/2008 | Scism | A61G 3/0209 414/462 |
| 2009/0016866 | A1 * | 1/2009 | Zaragoza | A61G 3/0209 414/541 |
| 2012/0275891 | A1 | 11/2012 | Pace et al. | |
| 2016/0023586 | A1 | 1/2016 | Potticary et al. | |
| 2018/0360676 | A1 * | 12/2018 | Taschner | A61G 3/061 |

OTHER PUBLICATIONS

Scooterboy—Examples of installation. Ladeboy.
Video clip entitled "Ford eChair" uploaded by user "Ford Media" published on Nov. 3, 2016, Retrieved from Internet https://www.youtube.com/watch?v=KPUnNYOPAhU.

* cited by examiner

LIFTING DEVICE FOR A WHEELCHAIR, AND MOTOR VEHICLE

CROSS-REFERENCE TO RELATED APPLICATIONS

This application claims foreign priority benefits under 35 U.S.C. § 119(a)-(d) to DE Application 10 2017 220 197.5 filed Nov. 14, 2017, which is hereby incorporated by reference in its entirety.

TECHNICAL FIELD

The disclosure relates to a lifting device for lifting a wheelchair, preferably an electric wheelchair, into a rear loading space of a motor vehicle and for lifting the wheelchair out of the loading space. The disclosure furthermore relates to a motor vehicle having a rear loading space and a lifting device for lifting a wheelchair, preferably an electric wheelchair, into the loading space and for lifting the wheelchair out of the loading space.

BACKGROUND

Loading a wheelchair, preferably an electric wheelchair, into a motor vehicle is a problem for people with limited mobility who would like to drive the motor vehicle themselves. The wheelchair will hereinafter be referred to for simplicity as an electric wheelchair. Either the electric wheelchair has to be manually disassembled by a person sitting in a driver's seat, whereupon the individual and potentially soiled components of the electric wheelchair have to be lifted and disposed on the passenger side of the motor vehicle, this being associated with a high outlay in terms of time and effort. Alternatively, a cost-intensive mechanical system can be installed in or on the motor vehicle, respectively, said mechanical system potentially having a mechanical arm, for example, which requires a lot of time in order to extend from the rear of the motor vehicle toward the front or the front side, respectively, to acquire the electric wheelchair, then to move the electric wheelchair to the rear of the motor vehicle, and finally to lift the electric wheelchair into the rear loading space of the motor vehicle.

The video available at this link https://www.youtube.com/watch?v=KPUnNYOPAhU shows an automated handling of an electric wheelchair. The automation comprises an autonomous driving function of an electric wheelchair, on account of which the electric wheelchair can drive autonomously from a driver's door region of the motor vehicle to the rear of the motor vehicle, and vice versa. The automation moreover comprises an autonomous loading and unloading function of a lifting arrangement that is disposed on the motor vehicle or in a loading space at the rear, respectively, by way which the electric wheelchair that is positioned on a liftable platform of the lifting arrangement to the rear of the motor vehicle can be lifted into the rear loading space of the motor vehicle and be lifted out of the loading space.

The limitations in the design of the autonomous loading and unloading function, or of a lifting arrangement that is equipped with such a function, respectively, are that firstly no structural modifications, such as, for example, a change to a tailgate mechanism, an alteration of a motor vehicle floor pan and the like, on the vehicle should be necessary, and that all equipment components that are required for the loading and unloading function, or for the lifting arrangement, respectively, should be defined as accessories which can be readily disposed on the motor vehicle and potentially be later removed from the motor vehicle again without damage to the motor vehicle. It is moreover recommended that the equipment components that are required for the loading and unloading function, or for the lifting arrangement, respectively, are provided as optional equipment components of a motor vehicle available to order such that the costs and the complexity of the motor vehicle can be minimized. For example, the opening of a tailgate by way of an actuator should be based on an item of vehicle equipment that is present and not on a new design.

DE 20 2014 100 151 U1 relates to a wheelchair loading device for selectively loading a wheelchair into and unloading the wheelchair from a motor vehicle. The wheelchair loading device is releasably connectable to the motor vehicle and comprises: a main body that is different from the motor vehicle and that for releasably connecting the wheelchair loading device to the motor vehicle is releasably coupleable to the motor vehicle; two pivot arms which are pivotably attached to said main body and which are mutually spaced apart transversely to the respective longitudinal extent of said pivot arms; a receptacle installation for receiving the wheelchair, wherein the receptacle installation is connected to each of the pivot arms such that the wheelchair that is coupled by means of the receptacle installation is movable by conjoint pivoting of the two pivot arms; and a drive installation for driving pivoting movements of the two pivot arms.

US 2016/0023586 A1 relates to a lifting arrangement for a vehicle, having a mounting which is conceived for fastening to the vehicle, a lifting arm which is rotatably coupled to the mounting, and a docking structure which is supported by the lifting arm and is conceived for lifting a personal mobility means, wherein the docking structure includes an electrical connector for the electrical connection to an electrical connector of the personal mobility means.

U.S. Pat. No. 4,616,972 A discloses a device for loading a wheelchair into a trunk space of a passenger motor vehicle. The chassis comprises an upper portion which defines guide rails in which a slide can roll, and a lower portion which is fastened to the lower face of the trunk space. Folding support means are provided between the upper and the lower portion such that the upper portion during a loading procedure can be lowered in the direction of the lower portion. Crank and lever means are used such that the slide, when the chair is lifted and rotated into the rear loading space, is moved from the rearwardmost to the forwardmost position of said slide while the upper portion is being lowered. A locking mechanism to prevent any undesired movement of the slide when the slide is in the rearwardmost loading or unloading position thereof is present.

US 2012/0275891 A1 discloses a wheelchair lifting device for loading a wheelchair into the trunk space of a motor vehicle. The wheelchair lifting device comprises a main frame which can be installed in the trunk space of a motor vehicle, a wheelchair platform for holding a wheelchair, a sliding frame for displacing the wheelchair platform into the trunk space or out of the latter, and a pivotable lifting mechanism for lifting and lowering the wheelchair platform.

US 2007/0189885 A1 relates to a device for removing a wheelchair from the trunk space of a motor vehicle. The device is collapsible and in the collapsed state thereof can readily fit into the trunk space of a motor vehicle.

US 2005/0105995 A1 relates to a lifting assembly having a first telescopic element which has a flange for fastening the lifting assembly to a vehicle, a second telescopic element which is connected to the first telescopic element, and a tool which is coupled to the second telescopic element, wherein the tool is movable along two orthogonal motion axes which are established by the two telescopic elements.

U.S. Pat. No. 7,306,422 B2 discloses a wheelchair lift installation which in an operatively connected manner has: a platform for supporting a passenger; a lift mechanism to which the platform, in a manner adjacent to the inwardly directed end thereof, is pivotably connected, wherein the mechanism is adapted to be fastened to a vehicle in order for the platform to be moved between a floor-level position, a transfer-level position, and a vertically retracted position, and vice versa; wherein the lift mechanism has at least one parallelogram structure which includes a vertical lifting arm and an articulated lever assembly, the latter two being activatable by way of the parallelogram structure in order for the platform to be pivoted out of the transfer position and to the retracted position; wherein the articulated lever assembly has connection systems which extend between the vertical lifting arm and the platform and have a thrust arm which is pivotably connected to the inwardly directed end of the platform; a barrier plate which in a manner adjacent to the inwardly directed end of the platform is pivotably fastened to the platform and is movable between a raised safety lock position and a lowered bridge position when the platform is in the transfer-level position. The connection system furthermore comprises a lock activation connection member for moving the barrier plate between the raised safety lock position and the lowered bridge position, wherein the lock activation connection member is connected so as to be pivotable between the thrust arm and the barrier plate.

U.S. Pat. No. 9,139,122 B2 relates to a device for loading a wheelchair into a vehicle, and for automatically mounting the wheelchair in a housing which protects the wheelchair and the mechanisms of the device from the influence of weather during transportation. The housing is disposed on a portion of a loading floor of a pick-up truck such that the use of the loading floor for other purposes is enabled when the mechanisms of the device are in the storage position.

The publication "SCOOTERBOY—Examples of installation" available at the link http://www.rausch-technik.com/products/wheelchairloadingsy–/scooterboy/wheelchair-or-scooter-in-the-trunk/examples-of-installation/#! discloses a lifting assembly for lifting an electric wheelchair into a rear loading space of a motor vehicle and for lifting the electric wheelchair out of the loading space. To this end, the lifting assembly comprises a platform which is liftable from the floor into the loading space, or vice versa is lowerable, the electric wheelchair being positionable on said platform.

SUMMARY

The instant disclosure is based on the object of providing a lifting device for a wheelchair, thus for an electric wheelchair, on a motor vehicle that can be implemented in a simple manner in terms of construction and in a cost-effective manner.

The object may be achieved according to the disclosure by a lifting device having at least two lifting assemblies which are fastenable to a loading space floor so as to be mutually spaced apart in a vehicle transverse direction, or on mutually opposite loading space side walls of the loading space, and which have in each case one pivot bearing that is fastenable to the loading space floor or to one of the loading space side walls at least one telescopic lifting arm that by way of a first end portion is connected to the pivot bearing so as to be pivotable about a pivot axis that runs in the vehicle transverse direction, at least one actuator which for pivoting the lifting arm about the pivot axis engages on the lifting arm, and at least one actuator which for telescoping the lifting arm engages on the lifting arm. The lifting device according to the disclosure moreover comprises at least one transverse stay which runs in the vehicle transverse direction and which is connected to free end portions of the lifting arms, and at least one electrically actuatable coupling unit which is disposed on the transverse stay and which in a coupling state is coupled at least indirectly to the electric wheelchair and in an uncoupling state is at least indirectly uncoupled from the electric wheelchair.

It is to be pointed out that the features and measures set forth individually in the following description may be combined with one another in any desired technically meaningful way and disclose further configurations of the disclosure. The description, in particular, in conjunction with the figures, characterizes and specifies the disclosure further.

The disclosure can be preferably combined with an autonomous driving function of an electric wheelchair, by way of which the electric wheelchair can drive autonomously around the motor vehicle, potentially by way of additionally availing of a function, for example a perimeter monitoring function, of the motor vehicle. On account thereof, the electric wheelchair upon a person alighting therefrom can drive from a driver's door region of the motor vehicle to the rear of the motor vehicle to a loading position in which the lifting device according to the disclosure can engage on the electric wheelchair in order for the latter to be lifted into the rear loading space. In the loading position, a rear side of the electric wheelchair preferably faces the rear of the motor vehicle. The autonomous driving function of the electric wheelchair moreover serves for the electric wheelchair that by means of the lifting device according to the disclosure has been lifted out of the rear loading space being able to autonomously drive from the unloading position of said electric wheelchair that is disposed behind the rear of the motor vehicle to a seating position beside the motor vehicle, in which a person sitting in the driver's seat of the motor vehicle can take a seat on the electric wheelchair. The tailgate, upon manual activation of an operating element on the motor vehicle or on a remote control, for example on a smartphone or the like that in terms of signal technology is coupled to the motor vehicle, can be moved to the open position of said tailgate before or when the electric wheelchair autonomously drives to the loading position of the latter behind the rear of the motor vehicle. When a person with limited mobility has moved from the electric wheelchair to the driver's seat said person can manually and/or by voice control activate the autonomous driving function of the electric wheelchair, for example directly on the electric wheelchair or by way of a remote control which can be formed, for example, by the motor vehicle or by a smartphone, such that the electric wheelchair drives in an autonomous manner to the rear loading position. An autonomous loading procedure by way of the lifting device according to the disclosure can subsequently be carried out, on account of which the electric wheelchair is lifted into the rear loading space of the motor vehicle.

In order for the electric wheelchair to be lifted from the rear loading position thereof, in which the rear side of the electric wheelchair preferably faces the rear of the motor vehicle, into the rear loading space of the motor vehicle, the lifting arms can first be pivoted in a synchronized manner about the locationally-fixed pivot axis, from the resting positions of said lifting arms, in the direction of a rear loading space opening of the loading space, said loading space opening having released to the open position thereof by the prior pivoting of a tailgate which in a closed position closes the loading space opening and in an open position releases the loading space opening. The lifting arms can be deployed simultaneously, in a temporally overlapping manner, or subsequently. On account of said simultaneous movements of the lifting arms, the transverse stay and the coupling unit disposed on the latter can be moved to the direct proximity of the electric wheelchair, or of the rear side of the electric wheelchair, respectively, or can contact the electric wheelchair.

The coupling unit can then be activated, or be transferred from the uncoupling state thereof to the coupling state thereof, on account of which the electric wheelchair is coupled to the lifting device. The lifting arms can thereafter be retracted, on account of which the electric wheelchair rolls in the direction of the motor vehicle until the rear wheels of the electric wheelchair contact a rear portion of the motor vehicle that adjoins the loading space opening on the floor of the latter, said rear portion having a rear bumper and/or a lower body protection that is disposed on said rear portion.

The lifting arms, by way of an electric actuation of the actuators provided for pivoting the lifting arms, are subsequently pivoted about the locationally-fixed pivot axis in the direction of the rear loading space and herein are inter alia pivoted upward, on account of which the electric wheelchair is lifted. The rear wheels of the electric wheelchair herein roll along the rear portion of the motor vehicle. The lifting arms are deployed during said pivoting movement of the lifting arms in order to prevent the electric wheelchair tilting backward while the latter is being lifted. The electric wheelchair, on account thereof, can be held in an upright position during the entire loading procedure, or when being lifted into the rear loading space, respectively.

As soon as the electric wheelchair has been lifted sufficiently high, or as soon as the rear wheels of the electric wheelchair are disposed substantially or completely above a lower edge of the loading space opening, the lifting arms are retracted again while the pivoting movement of the lifting arms into the rear loading space continues. Said simultaneous movements of the lifting arms pull the electric wheelchair into the rear loading space, wherein the electric wheelchair rolls across the loading space floor in the forward direction of the motor vehicle until said electric wheelchair has assumed a desired loaded position thereof in which the electric wheelchair is disposed completely within the rear loading space.

The lifting device can remain coupled to the electric wheelchair in the loaded position of the latter so as to be able to secure the loaded position of the electric wheelchair relative to the motor vehicle. Alternatively, the lifting device can be uncoupled from the electric wheelchair in the loaded position of the latter and be transferred to a resting position. In this case, the loaded position of the electric wheelchair relative to the motor vehicle has to be mechanically secured in another way. The unloading procedure, or the lifting of the electric wheelchair out of the rear loading space, respectively, is performed by carrying out the aforementioned steps in a reversed order.

The lifting device according to the disclosure by way of the two pivot bearings is fastened either to the loading space floor or to mutually opposite loading space side walls of the loading space. The actuator that for pivoting the lifting arm about the locationally fixed pivot axis engages on the respective lifting arm can be supported on the lifting arm, on the one hand, and on a portion of the pivot bearing, on the other hand. The actuator, on account thereof, does not have to be additionally supported on the loading space floor, or on the respective loading space side wall, this simplifying the assembly of the lifting device. The actuator can be electrically actuatable and in particular have at least one electric motor. The actuator can additionally have a gearbox that interacts with the electric motor. The actuator can be connected to an electric power supply of the motor vehicle, wherein the power supply can be controlled by means of an electronics system according to a predefined power supply profile in order for the above-described loading procedure, or unloading procedure, respectively, to be able to be carried out.

Each lifting arm comprises two, three, or a plurality of elements which are mutually relatively displaceable in a linear manner and which are mutually relatively displaced in a linear manner in order for the lifting arm to be telescoped. The actuator for telescoping the respective lifting arm herein is supported on two different elements of the lifting arm which are mutually relatively displaceable in a linear manner. The actuator can be electrically actuatable and in particular have at least one electric motor. The actuator can additionally have a gearbox that interacts with the electric motor. The actuator can be connected to an electric power supply of the motor vehicle, wherein the power supply can be controlled by means of an electronics system according to a predefined power supply profile in order for the above-described loading procedure, or unloading procedure, respectively, to be able to be carried out.

The transverse stay can be configured as a hollow profile, for example, or so as to be solid. The coupling unit can be disposed so as to be centric on the transverse stay, for example. The coupling unit can engage directly on a component of the electric wheelchair, or be coupled directly to the electric wheelchair, respectively. Alternatively, the coupling unit by way of a component that is additionally disposed on the electric wheelchair can engage indirectly on a component of the electric wheelchair, or be coupled indirectly to the electric wheelchair, respectively. The lifting device can also have two or a plurality of coupling units that are disposed on the transverse stay.

The entire lifting device can be readily disposed on the motor vehicle in the context of a retrofit of a motor vehicle. The lifting device can, in particular, be an optional item of equipment of the motor vehicle which is installed in the motor vehicle ex works on request by a customer. Since only the two pivot bearings have to be connected to the motor vehicle, no modifications in terms of construction are required on the motor vehicle in order for the disclosure to be implemented. The lifting device can moreover be readily uninstalled from the motor vehicle again without the motor vehicle being damaged. Furthermore, no special actuator is required on the electric wheelchair in order for the disclosure to be implemented or for the electric wheelchair to be loaded and unloaded.

The motor vehicle is in particular a passenger motor vehicle having a rear loading space which is closable by a tailgate that is configured so as to be at least in one part, wherein the tailgate by means of at least one electric actuator of the motor vehicle is pivotable between the closed position of said tailgate, closing the loading space opening of the loading space, and an open position that releases the loading space opening.

According to one advantageous design embodiment, the coupling unit comprises at least one electromagnet. On account thereof, the coupling unit can be at least indirectly coupled to the electric wheelchair in that the electromagnet is energized so as to generate a magnetic field by way of which a metallic component of the electric wheelchair, or an additional metallic component that is fastened to the electric wheelchair, is attracted by the electromagnet. The coupling force generated on account thereof between the coupling unit and the metallic component is sufficiently strong in order for the desired lifting procedure with the electric wheelchair to be able to be carried out. Alternatively, the electromagnet can be used for activating or repositioning, respectively, a coupling element of the coupling unit, a form-fit between the coupling unit and a component of the electric wheelchair or a component that is additionally disposed on the electric wheelchair being establishable by repositioning said coupling element. Of course, permanent magnets of a corresponding strength can also be used; however, said permanent magnets should be embodied such that the required retaining force is provided but also that the required releasing force is not excessive.

The lifting device advantageously comprises at least one metal plate which is at least indirectly fastenable to the electric wheelchair and which in the case of a coupling unit that is in the coupling state thereof is attracted by the electromagnet by way of a magnetic field generated by the electromagnet. The metal plate is magnetic, in particular ferromagnetic, such that the metal plate can be attracted by the electromagnet. An existing electric wheelchair can be readily retrofitted with the metal plate.

According to one further advantageous design embodiment, the lifting device comprises at least one joint which is connected to the metal plate and by way of which the metal plate is connectable to the electric wheelchair so as to be pivotable about a rotation axis that is parallel with the vehicle transverse direction. On account thereof, the metal plate when being lifted into or lifted out of, respectively, the rear loading space can be rotated about the rotation axis relative to the electric wheelchair, or relative to the backrest of the electric wheelchair, respectively, such that a reliable contact is guaranteed between the coupling unit and the metal plate.

One further advantageous design embodiment provides that the transverse stay is configured so as to be adjustable in the length thereof. On account thereof, the lifting device can be produced in a standardized manner and in the assembly can be readily adapted to different load space widths, or vehicle models, respectively. This reduces the production costs. The transverse stay can have, for example, at least two profiled elements which can be fixed in different mutual relative positions, wherein one profiled element can be guided in the other profiled element. At least one mechanical fixing means for fixing the respective relative position between the profiled elements can be disposed on the transverse stay.

According to one further advantageous design embodiment, the lifting device comprises at least one actuation electronics system which is connected to the actuators and to the coupling unit and which is set up for actuating the actuators and the coupling unit in such a manner that the electric wheelchair when lifted into or out of, respectively, the loading space is held upright and rear wheels of the electric wheelchair herein roll along a rear portion of the motor vehicle. The actuation electronics system can be implemented by an onboard vehicle electronics system or by a separate electronics system. The electronics system can be remote controllable, to which end the electronic system can be connected to a signals unit in a wireless or wired manner, the electronics system being activatable by way of activation of said signals unit. On account of the electric wheelchair during the loading procedure, or the unloading procedure, respectively, by way of the rear wheels of the electric wheelchair being supported on the rear portion of the motor vehicle, only very minor transverse forces act on the lifting device in a manner transverse to the motion planes of the lifting arms, such that the lifting device in this respect can be configured so as to be less robust and thus lighter in weight. At the same time, reliable guiding of the electric wheelchair is ensured during the loading procedure, or the unloading procedure, respectively.

The actuation electronics system is advantageously set up for actuating the actuators and the coupling unit in such a manner that the lifting arms in a resting state of the lifting device, proceeding from the pivot bearings, run in a forward direction. On account thereof, the loading space volume of the rear loading space is compromised as little as possible by the lifting device. Moreover, manual loading of the rear loading space with other cargoes is not impeded on account of the lifting device that is present in the loading space. The lifting arms herein can run flat across the loading space floor and point in the direction of the rear seats of the motor vehicle.

It is furthermore advantageous for the actuation electronics system to be set up for actuating the actuators and the coupling unit in such a manner that the coupling unit, with the electric wheelchair having been lifted into the loading space, remains in the coupling state of said coupling unit. On account thereof, the lifting device can be utilized for holding the electric wheelchair securely in the loaded position thereof relative to the motor vehicle, in particular when the motor vehicle is traveling.

The above object is furthermore achieved according to the disclosure by a motor vehicle having the features of claim 9, wherein the lifting device is configured according to one of the preceding design embodiments or any arbitrary combination of at least two of said design embodiments.

The advantages mentioned above in the context of the lifting device apply in an analogous manner to the motor vehicle. The motor vehicle can in particular be a passenger motor vehicle. The motor vehicle can be set up to communicate with the electric wheelchair in terms of signaling technology, for example in order for the electric wheelchair to be supported in the autonomous driving operation of the latter, or in order to be able to intervene in the autonomous driving operation of the electric wheelchair should the electric wheelchair not move to a desired loading position or come too close to the motor vehicle during the autonomous driving operation. To this end, the motor vehicle can have, for example, a perimeter sensor system by way of which objects and the respective position thereof in the surroundings of the motor vehicle are detectable.

Further advantageous configurations of the disclosure are disclosed in the dependent claims and in the following description of the figures. In the figures:

DETAILED DESCRIPTION

In the different figures, identical parts are always provided with the same reference signs, and so said parts are generally also described only once.

Figure 1:
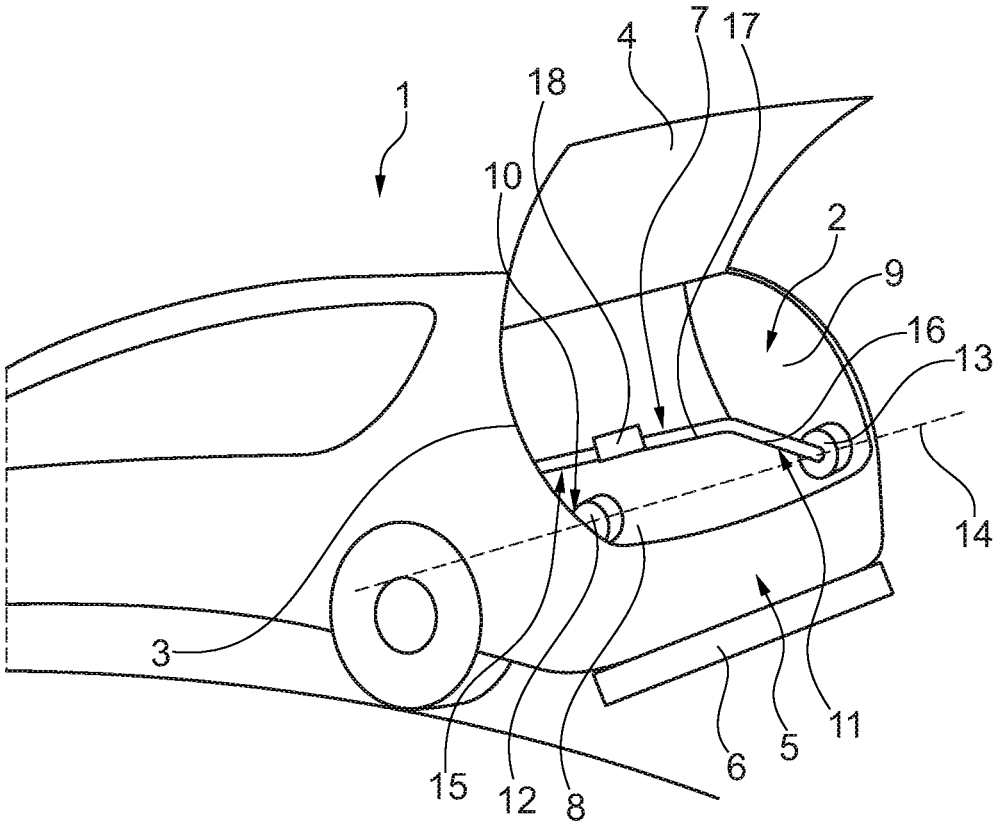
FIG. 1 shows a schematic and perspective illustration of an exemplary embodiment for a motor vehicle according to the disclosure, having a lifting device that is in a resting position.

FIG. 1 shows a schematic and perspective illustration of an exemplary embodiment for a motor vehicle 1 according to the disclosure in the form of a passenger motor vehicle.

The motor vehicle 1 has a rear loading space 2 having a rear loading space opening 3 and a tailgate 4 which in a closed position (not shown) closes the loading space opening 3 and in the open position shown releases the loading space opening 3. A rear portion 5 of the motor vehicle 1 adjoins the loading space opening 3 on the floor of the latter, said rear portion 5 configuring a rear bumper (not shown) of the motor vehicle 1, and having a protective element 6 that is disposed so as to be offset toward the floor in relation to the bumper.

The motor vehicle 1 furthermore has a lifting device 7 for lifting an electric wheelchair (not shown in FIG. 1) into the rear loading space 2 and for lifting the electric wheelchair out of the loading space 2. The lifting device 7 has two lifting assemblies 10 and 11 which are fastened to a loading space floor 8 so as to be mutually spaced apart in a vehicle transverse direction, or alternatively fastened to mutually opposite loading space side walls 9 of the loading space 2.

Each lifting assembly 10 or 11, respectively, has a pivot bearing 12 or 13, respectively, that is fastened to the loading space floor 8, or alternatively to one of the loading space side walls 9, a telescopic lifting arm 15 or 16, respectively, that by way of a first end portion is connected to the pivot bearing 12 or 13, respectively, so as to be pivotable about a pivot axis 14 that runs in the vehicle transverse direction, an actuator (not shown) which for pivoting the lifting arm 15 or 16, respectively, about the pivot axis 14 engages on the lifting arm 15 or 16, respectively, and an actuator (not shown) which for telescoping the lifting arm 15 or 16, respectively, engages on the lifting arm 15 or 16, respectively.

The lifting device 7 furthermore has a transverse stay 17 which runs in the vehicle transverse direction and which is connected to free end portions of the lifting arms 15 and 16. The transverse stay 17 can be configured so as to be adjustable in the length thereof.

The lifting device 7 moreover has an electrically actuatable coupling unit 18 which is disposed on the transverse stay 17 and which in a coupling state is coupled at least indirectly to the electric wheelchair and in an uncoupling state is uncoupled from the electric wheelchair. The coupling unit 18 can have at least one electromagnet (not shown). The lifting device 7 herein can have at least one metal plate (not shown) which is at least indirectly fastenable to the electric wheelchair and which in the case of a coupling unit 18 that is in the coupling state thereof is attracted by the electromagnet by way of a magnetic field generated by the electromagnet. To this end, the lifting device 7 can moreover have at least one joint (not shown) which is connected to the metal plate and by way of which the metal plate is connectable to the electric wheelchair so as to be pivotable about a rotation axis that is parallel with the vehicle transverse direction.

Figure 4:
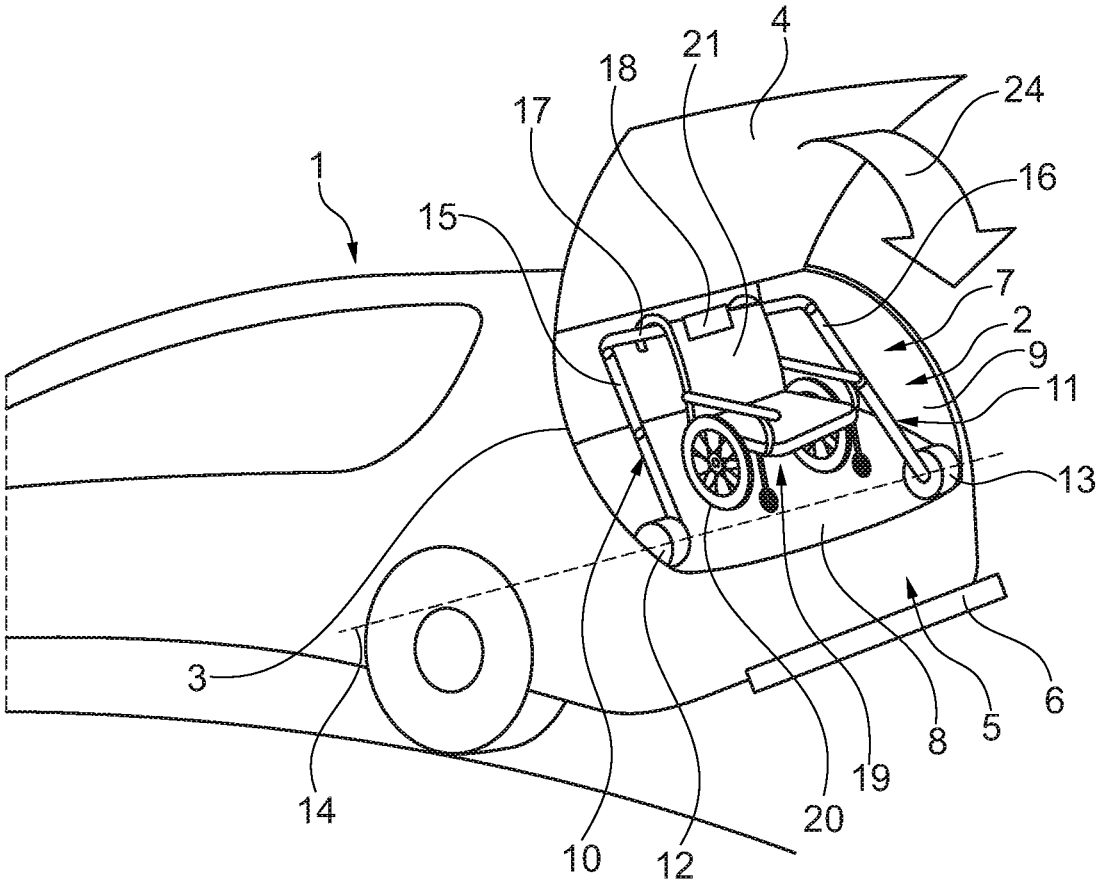
FIG. 4 shows a schematic and perspective illustration of the motor vehicle shown in FIG. 1, in a third loading state.

The lifting device 7 furthermore has an actuation electronics system (not shown) which is connected to the actuators and to the coupling unit 18 and which is set up for actuating the actuators and the coupling unit 18 in such a manner that the electric wheelchair when lifted into or out of, respectively, the loading space 2 is held upright and rear wheels of the electric wheelchair herein roll along the rear portion 5 of the motor vehicle 1. The actuation electronics system is set up for actuating the actuators and the coupling unit 18 in such a manner that the lifting arms 15 and 16 in the resting state shown of the lifting device 7, proceeding from the pivot bearings 12 and 13, run in a forward direction. The actuation electronics system is moreover set up for actuating the actuators and the coupling unit 18 in such a manner that the coupling unit 18, with the electric wheelchair having been lifted into the loading space 2, remains in the coupling state of said coupling unit 18, as is shown in FIG. 4.

Figure 2:
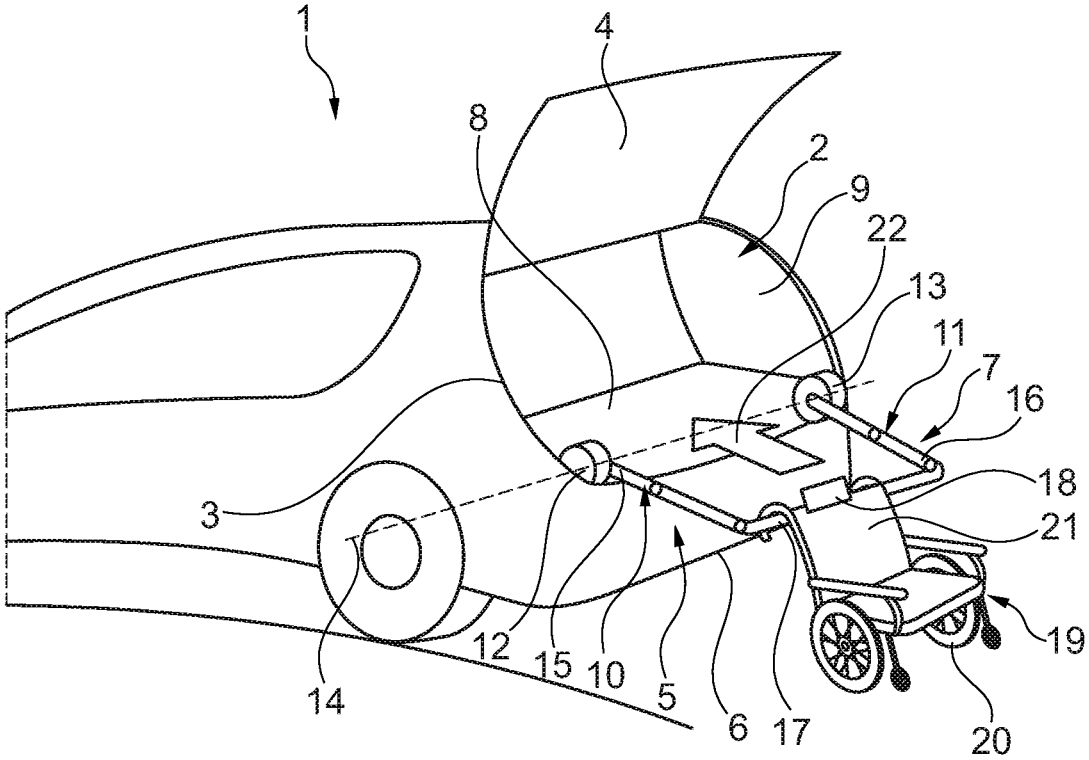
FIG. 2 shows a schematic and perspective illustration of the motor vehicle shown in FIG. 1, in a first loading state.

FIG. 2 shows a schematic and perspective illustration of the motor vehicle 1 shown in FIG. 1, in a first loading state. An electric wheelchair 19 which is disposed in a loading position behind the motor vehicle 1, the rear side of the former facing the motor vehicle 1, is moreover shown. The rear wheels 20 of the electric wheelchair 19 are thus positioned so as to face the motor vehicle 1.

The lifting device 7 has been transferred from the resting position thereof, shown in FIG. 1, to the loading state shown, in that the lifting arms 15 and 16 have been pivoted about the pivot axis 14 and the lifting arms 15 and 16 herein or subsequently have been deployed such that the transverse stay 17 and the coupling unit 18 disposed on the latter are disposed in the direct proximity of a backrest 21 of the electric wheelchair 19. The coupling unit 18 has subsequently been transferred from the uncoupling state thereof to the coupling state thereof, on account of which the electric wheelchair 19 is coupled to the lifting device 7. Next, the lifting arms 15 and 16 are retracted, on account of which the electric wheelchair 19 in a manner corresponding to arrow 22 is pulled in the direction of the motor vehicle 1 until the rear wheels 20 are in contact with the rear portion 5, as is shown in FIG. 3.

Figure 3:
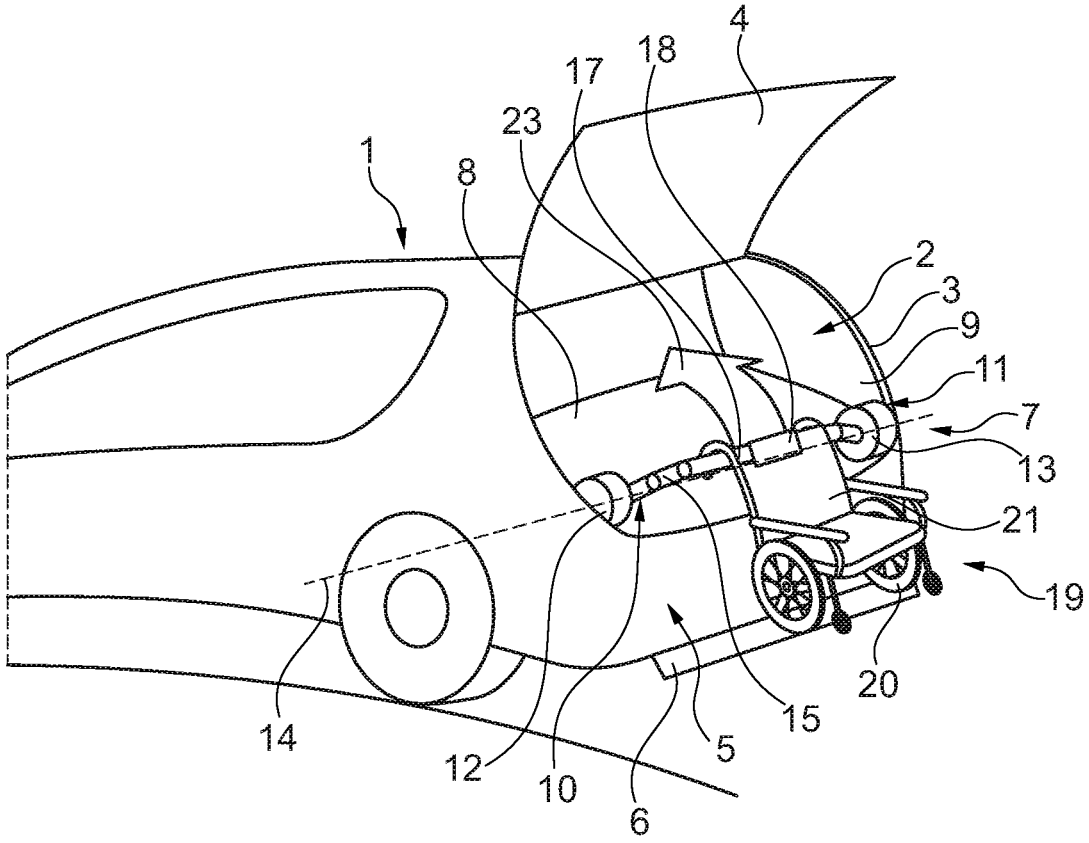
FIG. 3 shows a schematic and perspective illustration of the motor vehicle shown in FIG. 1, in a second loading state.

FIG. 3 shows a schematic and perspective illustration of the motor vehicle 1 shown in FIG. 1, in a second loading state. The lifting device 7 has been transferred from the loading state thereof, shown in FIG. 2, to the loading state shown, in that the lifting arms 15 and 16 by way of an electric actuation of the actuators (not shown) that are provided for pivoting the lifting arms 15 and 16 have been pivoted in a manner corresponding to arrow 23 about the pivot axis 14 in the direction of the rear loading space 2 and inter alia upward, on account of which the electric wheelchair 19 has been lifted. The rear wheels 20 of the electric wheelchair 19 herein have rolled substantially vertically along the rear portion 5 of the motor vehicle 1. The lifting arms 15 and 16 during said pivoting movement of the lifting arms 15 and 16 have moreover been deployed so as to prevent the electric wheelchair 19 tilting backward while the latter is being lifted.

FIG. 4 shows a schematic and perspective illustration of the motor vehicle 1 shown in FIG. 1, in a third loading state. The lifting device 7 has been transferred from the loading state thereof, shown in FIG. 3, to the loading state shown in that the lifting arms 15 and 16 have been retracted again as soon as the electric wheelchair 19 has been lifted sufficiently high, or as soon as the rear wheels 20 of the electric wheelchair 19 are disposed substantially or completely above a lower edge of the loading space opening 3, while the pivoting movement of the lifting arms 15 and 16 into the rear loading space 2 has continued. On account of said simultaneous movements of the lifting arms 15 and 16, the electric wheelchair 19 has been pulled into the rear loading space 2, wherein the electric wheelchair 19 has rolled across the loading space floor 8 in the forward direction of the motor vehicle 1 until said electric wheelchair 19 has assumed the shown loaded position in which the electric wheelchair 19 is disposed completely within the rear loading space 2. Lastly, the tailgate 4 can be pivoted in a manner corresponding to arrow 24, so as to close the loading space 2.

The lifting device 7 can remain coupled to the electric wheelchair 19 in the loaded position of the latter so as to be able to secure the loaded position of the electric wheelchair 19 relative to the motor vehicle 1. Alternatively, the lifting device 7 can be uncoupled from the electric wheelchair 19 in the loaded position of the latter and be transferred to the resting position shown in FIG. 1. In this case, the loaded position of the electric wheelchair 19 relative to the motor vehicle 1 has to be mechanically secured in another way.

The unloading procedure, or the lifting of the electric wheelchair 19 out of the rear loading space 2, respectively, is performed by carrying out the aforementioned steps in a reversed order.

What is claimed is:

1. A lifting device for lifting a wheelchair into and out of a rear loading space of a motor vehicle, comprising:

at least two lifting assemblies fastenable to a floor of the loading space, mutually spaced apart in a vehicle transverse direction, or on mutually opposite loading space side walls of the loading space, each of the lifting assemblies having a pivot bearing fastenable to the floor of the loading space or to one of the loading space side walls;

at least one telescopic lifting arm, wherein a first end portion is connected to the pivot bearing to be pivotable about a pivot axis that runs in the vehicle transverse direction;

at least one actuator, which, for pivoting the lifting arm about the pivot axis engages on the lifting arm;

at least one actuator, which, for telescoping the lifting arm engages on the lifting arm;

at least one transverse stay which runs in the vehicle transverse direction and which is connected to free end portions of the lifting arms; and at least one electrically actuatable coupling unit which is disposed on the transverse stay and which, in a coupling state, is coupled at least indirectly to the wheelchair and in an uncoupling state is uncoupled from the wheelchair.

2. The lifting device as claimed in claim 1, wherein the coupling unit comprises at least one electromagnet.

3. The lifting device as claimed in claim 2, further comprising at least one metal plate, at least indirectly fastenable to the wheelchair, wherein when the coupling unit is in the coupling state, the coupling unit is attracted to the at least one metal plate by the electromagnet per a magnetic field generated by the electromagnet.

4. The lifting device as claimed in claim 3, further comprising at least one joint connected to the metal plate and by way of which the metal plate is connectable to the wheelchair to be pivotable about a rotation axis that is parallel with the vehicle transverse direction.

5. The lifting device as claimed in claim 1, wherein the transverse stay is configured to be adjustable in length.

6. The lifting device as claimed in claim 1, further comprising at least one actuation electronics system which is connected to the actuators and to the coupling unit and which is set up for actuating the actuators and the coupling unit in such a manner that the wheelchair, when lifted into or out of, respectively, the loading space, is held upright and rear wheels of the wheelchair herein roll along a rear portion of the vehicle.

7. The lifting device as claimed in claim 6, wherein the actuation electronics system is set up for actuating the actuators and the coupling unit in such a manner that the lifting arms in a resting state of the lifting device, proceeding from the pivot bearings, run in a forward direction.

8. The lifting device as claimed in claim 6, wherein the actuation electronics system is set up for actuating the actuators and the coupling unit in such a manner that the coupling unit, with the wheelchair having been lifted into the loading space, remains in the coupling state of said coupling unit.

9. A vehicle, comprising:

lifting assemblies, fastened within a loading space of the vehicle, each having a pivot bearing;

a telescopic lifting arm, connected to the pivot bearings to pivot about an axis in a vehicle transverse direction;

a transverse stay which runs in the vehicle transverse direction, connected to free end portions of the lifting arms; and a coupling unit disposed on the transverse stay and configured to couple at least indirectly to a wheelchair, wherein the coupling unit includes an electromagnet configured to, when in a coupling state, generate a magnetic field to attract the wheelchair.

10. A vehicle, comprising:

lifting assemblies, fastened within a loading space of the vehicle, each having a pivot bearing;

a telescopic lifting arm, connected to the pivot bearings to pivot about an axis in a vehicle transverse direction;

a transverse stay which runs in the vehicle transverse direction, connected to free end portions of the lifting arms;

a coupling unit disposed on the transverse stay and configured to couple at least indirectly to a wheelchair;

an actuator configured to pivot the lifting arm about the pivot axis;

an actuator configured to telescope the lifting arm; and an actuation electronics system connected to the actuators and to the coupling unit, configured to hold the wheelchair upright when the wheelchair is being lifted into or out of the loading space, such that rear wheels of the wheelchair roll along a rear portion of the vehicle.

11. The vehicle as claimed in claim 10, wherein the actuation electronics system is configured to utilize the actuators to pivot the lifting arms from a resting state in which the transverse stay is within the loading space to a loading state in which the transverse stay is in proximity of a backrest of the wheelchair.

12. The vehicle as claimed in claim 10, wherein the actuation electronics system is configured to utilize the actuators to simultaneously retract the lifting assemblies and pivot the lifting arm to pull the wheelchair in the direction of the vehicle until rear wheels of the wheelchair are in contact with a rear portion of the vehicle.

13. The vehicle as claimed in claim 9, wherein the loading space of the vehicle is located at a rear of the vehicle.

14. The vehicle as claimed in claim 9, further comprising a tailgate configured to pivot to close the loading space when the wheelchair is disposed completely within the loading space.

15. The vehicle as claimed in claim 10, wherein the loading space of the vehicle is located at a rear of the vehicle.

16. The vehicle as claimed in claim 10, further comprising a tailgate configured to pivot to close the loading space when the wheelchair is disposed completely within the loading space.

* * * * *